US005660536A

United States Patent [19]

Karls et al.

[11] Patent Number: 5,660,536

[45] Date of Patent: Aug. 26, 1997

[54] HIGH CAPACITY SIMPLIFIED SEA WATER PUMP

[75] Inventors: Michael A. Karls, Hilbert, Wis.; Matthew W. Jaeger, Stillwater, Okla.; George E. Brown, Perkins, Okla.; Darrin L. Doty; Bruce A. Schroeder, both of Stillwater, Okla.

[73] Assignee: Brunswick Corporation, Lake Forest, Ill.

[21] Appl. No.: 583,714

[22] Filed: Jan. 5, 1996

[51] Int. Cl.[6] ..... F04C 5/00; F04C 13/00; F04C 15/00

[52] U.S. Cl. ..... 418/15; 418/133; 418/149; 418/152; 418/154

[58] Field of Search ..... 418/15, 133, 149, 418/152, 154

[56] References Cited

U.S. PATENT DOCUMENTS

| | | | |
|---|---|---|---|
| 2,466,440 | 4/1949 | Kiekhaefer | 418/154 |
| 2,664,050 | 12/1953 | Abresch | 418/154 |
| 2,712,792 | 7/1955 | Snyder | 418/154 |
| 3,164,098 | 1/1965 | Sully | 418/154 |
| 3,468,260 | 9/1969 | Belden | 418/152 |
| 4,181,472 | 1/1980 | Sharp | 418/154 |
| 4,392,779 | 7/1983 | Bloemers et al. | 418/154 |
| 4,421,462 | 12/1983 | Ohe | 418/15 |
| 4,496,297 | 1/1985 | Ogawa | 418/133 |
| 4,505,649 | 3/1985 | Masuda et al. | 418/149 |
| 4,718,837 | 1/1988 | Frazzell | 418/154 |
| 4,940,402 | 7/1990 | McCormick | 418/154 |

FOREIGN PATENT DOCUMENTS

| | | | |
|---|---|---|---|
| 3014147 | 10/1981 | Germany | 418/15 |
| 2161193 | 6/1990 | Japan | 418/15 |
| 381371 | 10/1932 | United Kingdom | 418/152 |

OTHER PUBLICATIONS

*Hydraulics & Pneumatics*, "Square Rings", May 1978.

Mercury Marine Sea Water Pump Serial No. C849992 thru D725646 and D725647 thru F213244, 465 Engine, pp. 40–43, Jan. 1995.

*Primary Examiner*—John J. Vrablik

*Attorney, Agent, or Firm*—Andrus, Sceales, Starke & Sawall

[57] ABSTRACT

A sea water pump (130) for a marine propulsion system includes a housing (130) having a generally cylindrical pumping chamber (134) defined by a generally cylindrical sidewall (136) extending axially between opposite end walls (138 and 140). A multi-vaned rotary impeller (44) in the chamber is driven by an impeller shaft (28) extending axially into the chamber through one of the endwalls (40). An intake port (146) at the other endwall (140) has a first branch (148) providing radial flow (170, 172) into the chamber, and a second branch (154) providing axial flow (178) into the chamber. A discharge port (158) has a first branch (160) receiving radial flow (174, 176) out of the chamber, and a second branch (166) receiving axial flow (180) out of the chamber. The housing (132) is an integrally molded one-piece cup-shaped unit including the cylindrical sidewall (136) integral with an end cap (144) providing a flat inner wall wear surface (140) providing the noted endwall engaging an axial end (50) of the impeller in sealing sliding relation.

10 Claims, 4 Drawing Sheets

HIGH CAPACITY SIMPLIFIED SEA WATER PUMP

BACKGROUND AND SUMMARY

The invention relates to sea water pumps for marine propulsion systems.

Sea water pumps for marine propulsion systems are known in the prior art, for example Mercury Marine Sea Water Pump Serial No. C849992 thru D725646 and D725647 thru F213244, 465 Engine, pages 40–43, January 1995, and U.S. Pat. Nos. 4,940,402, 4,392,779, 4,718,837 and 2,466,440, incorporated herein by reference. A generally cylindrical pumping chamber is defined by a generally cylindrical sidewall extending axially between opposite endwalls. A multi-vaned rotary impeller in the chamber is driven by an axially extending impeller drive-shaft. The impeller has a plurality of flexible vanes extending radially outwardly therefrom in the chamber and having outer tips engaging the sidewall. During rotation of the impeller shaft, the vanes move through portions of varying flexure to draw water in through an inlet port and discharge same through a discharge port. The endwalls of the chamber are engaged by the axial ends of the vanes in sealing, sliding relation.

In one aspect of the present invention, increased pumping capacity is enabled by enhanced intake and discharge port structure providing additional water flow.

In another aspect of the invention, both improved reliability and lower manufacturing cost are afforded by simplified housing structure providing multiple functions with a reduced number of parts.

In another aspect of the invention, previous areas of potential leakage are eliminated.

DETAILED DESCRIPTION

Prior Art

Figure 1:
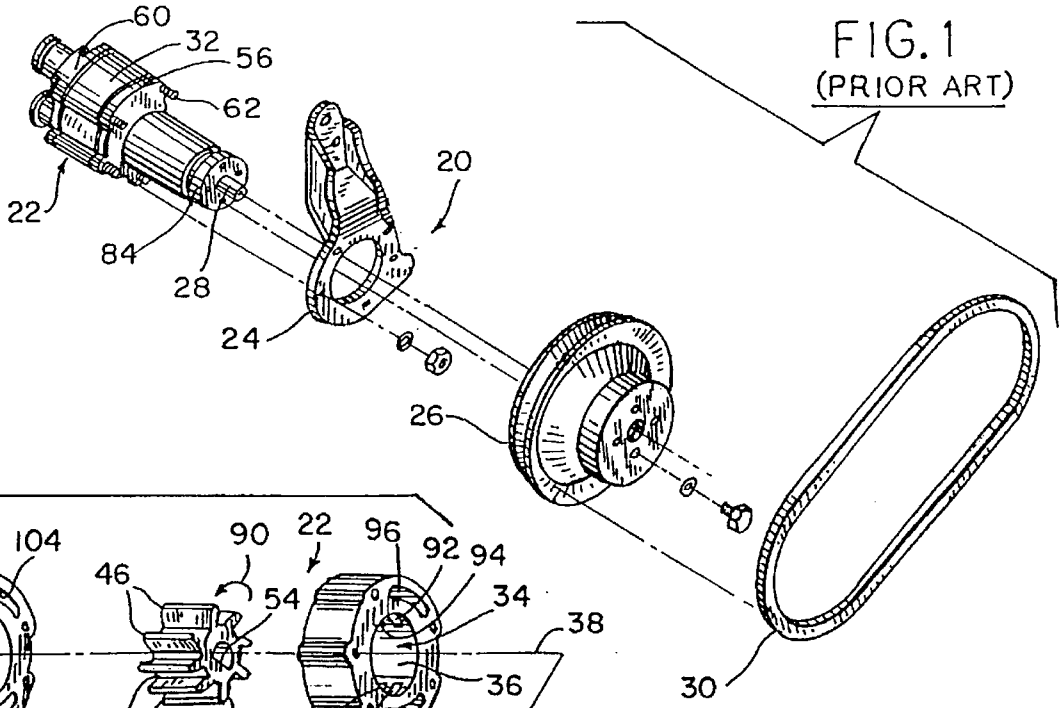
FIG. 1 (PRIOR ART)
FIG. 1 is an exploded perspective view of a sea water pump assembly for a marine propulsion system as known in the prior art.

FIG. 1 shows a sea water pump assembly 20 known in the prior art, namely Mercury Marine Sea Water Pump Serial No. C849992 thru D725646 , 465 Engine, pages 40–43, January 1995. The assembly includes a sea water pump 22, a bracket 24 for mounting the pump to a marine propulsion engine, a pulley 26 for drivingly rotating the impeller driveshaft 28 of the pump, and a V or serpentine belt 30 driven by an engine pulley (not shown) for drivingly rotating pulley 26.

Figure 2:
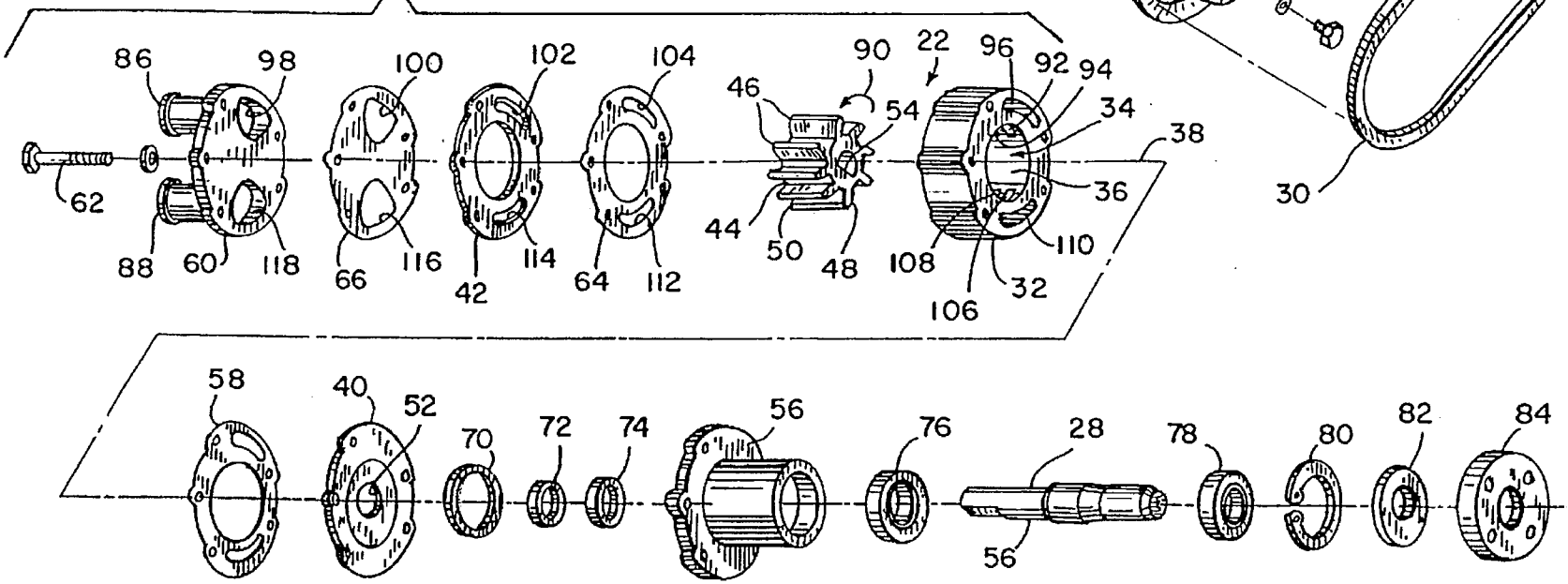
FIG. 2 (PRIOR ART)
FIG. 2 is a disassembled exploded perspective view of the pump of FIG. 1.
Figure 3:
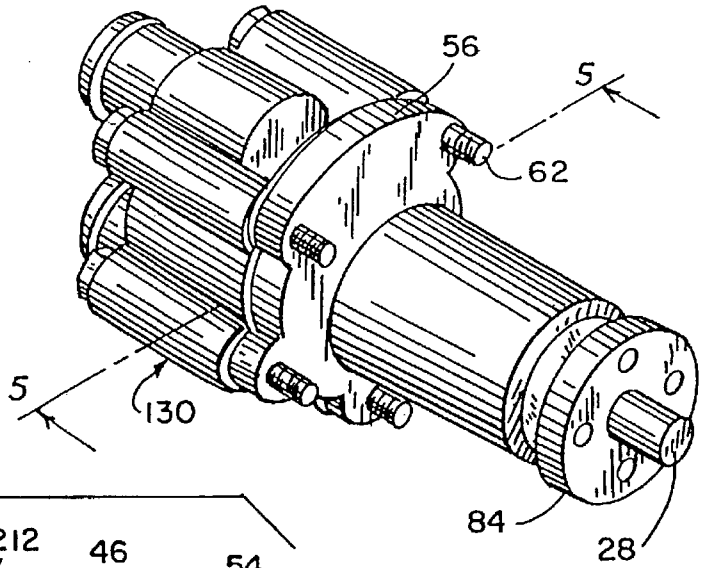
FIG. 3 is an isometric view of a sea water pump in accordance with the present invention.
Figure 4:
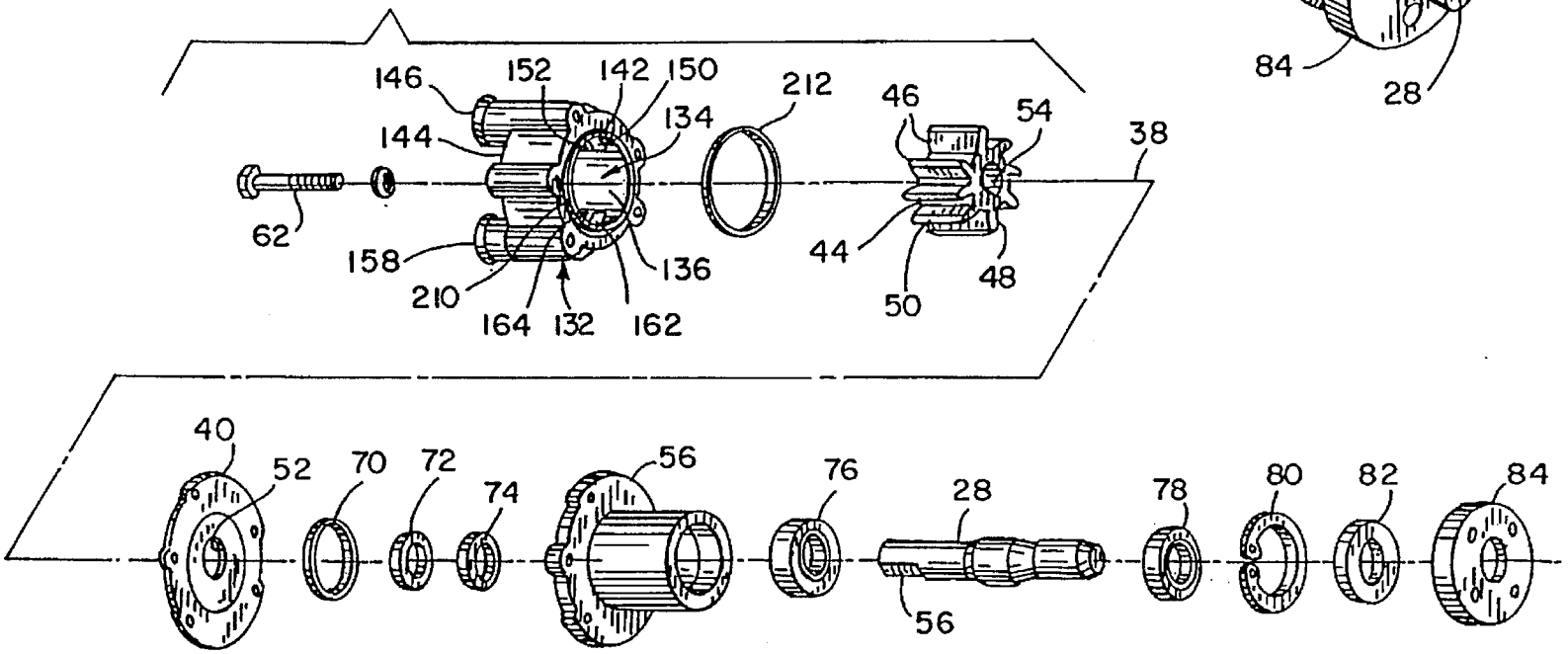
FIG. 4 is a disassembled exploded perspective view of the pump of FIG. 3.
Figure 5:
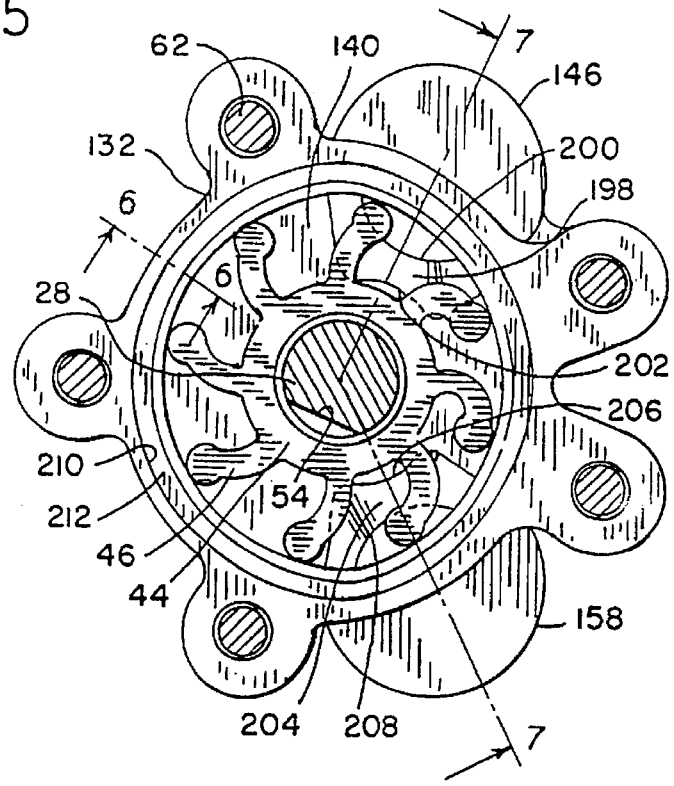
FIG. 5 is a sectional view taken along line 5—5 of FIG. 3.
Figure 6:
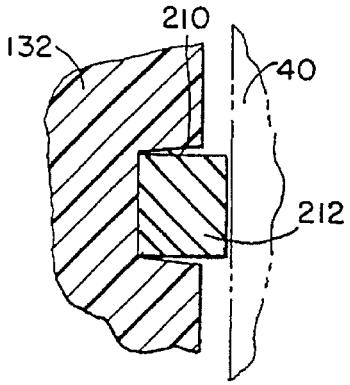
FIG. 6 is a sectional view taken along line 6—6 of FIG. 5.

Pump 22 includes a pump body or housing 32, FIG. 2, having a generally cylindrical pumping chamber 34 defined by a generally cylindrical sidewall 36 extending axially, i.e. along axis 38, and closed at each axial end by respective first and second wear plates 40 and 42. A rotary impeller 44 in the chamber has a plurality of vanes 46 flexing radially and engaging cylindrical sidewall 36 and having first and second opposite axial ends 48 and 50 engaging wear plates 40 and 42, respectively, in sealing, sliding relation. Impeller shaft 28 extends axially through wear plate 40 at aperture 52 and into chamber 34 and engages impeller 44 in keyed relation at D-shaped central aperture 54 in the impeller and flat spot 56 on shaft 28, and drivingly rotates impeller 44. Wear plate 40 is mounted to housing body 32 by end cap and bearing support 56. The interface between wear plate 40 and housing body 32 is sealed by gasket 58. Wear plate 42 is mounted to housing body 32 by end cap 60 by mounting bolts such as 62 which also extend through the other end cap 56. The interface between wear plate 42 and housing body 32 at cylindrical sidewall 36 is sealed by gasket 64. The interface between end cap 60 and wear plate 42 is sealed by gasket 66. The unit is completed by quad sealing ring 70 between wear plate 40 and end cap 56, seals 72 and 74 around impeller shaft 28, bearings 76 and 78, retaining snap ring 80, seal 82, and hub 84 for mating to the hub of pulley 26.

End cap 60, FIG. 2, has a pair of ports 86 and 88. For rotation of impeller 44 in the direction shown at arrow 90 in FIG. 2, port 86 is the intake port, and port 88 is the discharge port. As impeller 44 on impeller shaft 28 rotates about axis 38, vanes 46 are moving radially outwardly and expanding the space therebetween as they move past ports 92, 94, to draw water through such ports into chamber 34 from passage 96 in housing body 32. Intake port 86 of end cap 60 communicates with passage 96 through passage 98 of the end cap, aperture 100 of gasket 66, aperture 102 of wear plate 42, and aperture 104 of gasket 64. As vanes 46 pass ports 106, 108 in housing body 32, the vanes are moving radially inwardly and compressing the space therebetween, to force water in chamber 34 out through ports 106 and 108 into passage 110 in housing body 32. Passage 110 communicates with discharge port 88 through aperture 112 in gasket 64, aperture 114 in wear plate 42, aperture 116 in gasket 66, and passage 118 in end cap 60. The direction of water flow into chamber 34 is radial, i.e. from passage 96 radially inwardly through ports 92 and 94 into chamber 34. Water flow out of chamber 34 is radial, i.e. from chamber 34 radially outwardly through ports 106 and 108 into passage 110. Before water enters chamber 34, the water flow is axial, i.e. from intake port 86 to passage 96. After water exits chamber 34, the water flow is axial, i.e. from passage 110 to discharge port 88. The roles of ports 86 and 88 can be reversed by reversing the direction of rotation of impeller 44, all as is known in the prior art.

Present Invention

FIGS. 3–7 use the same reference characters from FIGS. 1 and 2 where appropriate to facilitate understanding. Sea water pump 130, FIG. 3, includes a housing 132, FIG. 4, having a generally cylindrical pumping chamber 134 defined by a generally cylindrical sidewall 136 extending axially, i.e. along axis 38, between opposite endwalls 138 and 140, FIG. 7. Housing 132 is an integrally molded one-piece cup-shaped housing unit having a generally straight-sided cylindrical sidewall 136 integral with a flat endwall 140 to define a generally cylindrical chamber 134 which is open at end 142, FIGS. 4 and 7, and which is closed at the other end 144 by integral endwall 140. Endwall 138 is formed by wear plate 40. Impeller shaft 28 extends through aperture 52 in wear plate 40 into chamber 134. Wear plate 40 closes chamber 134 at open end 142.

Figure 7:
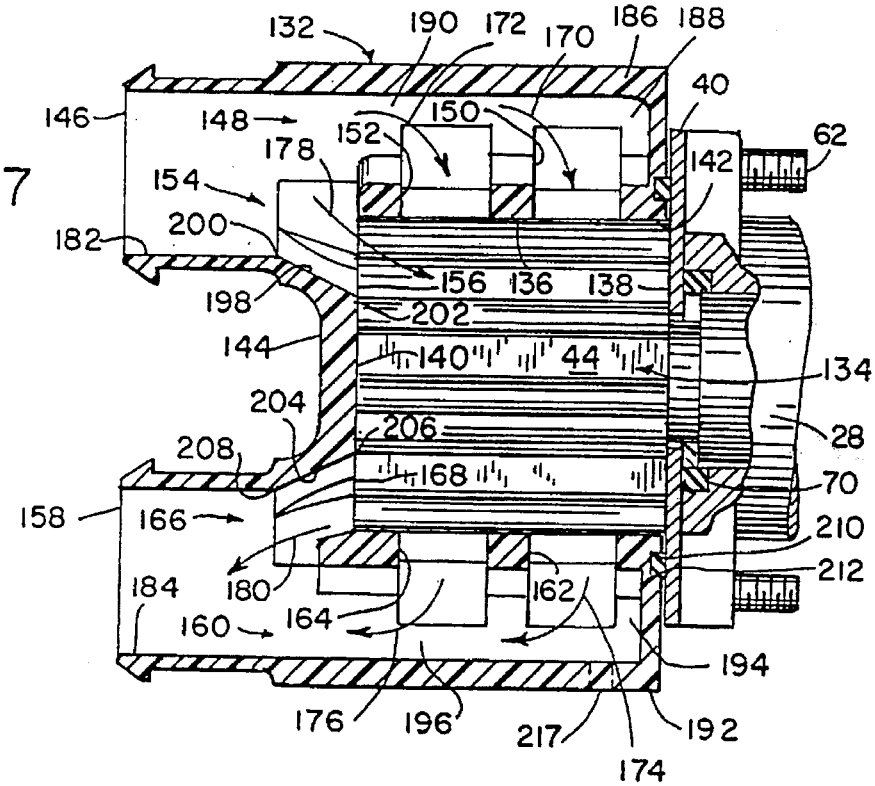
FIG. 7 is a sectional view taken along line 7—7 of FIG. 5.

Housing 132 has an intake port 146, FIG. 7, having a first branch 148 communicating with chamber 134 through openings 150 and 152 through sidewall 136. Intake port 146 has a second branch 154 communicating with chamber 134 through opening 156 through endwall 140. Housing 132 includes a discharge port 158 having a branch 160 communicating with chamber 134 through openings 162 and 164 through sidewall 136. Discharge port 158 has another branch 166 communicating with chamber 134 through an opening 168 through endwall 140. Water flow through openings 150, 152, 162 and 164 is radial, as shown at respective arrows 170, 172, 174, 176, similarly to the radial flow of water into and out of chamber 34 in FIG. 2. Water flow through openings 156 and 168, FIG. 7, is axial, as shown at respective arrows 178 and 180.

Intake and discharge ports 146 and 158, FIG. 7, each extend axially from endwall 140. The intake and discharge ports each include axially extending respective intake and discharge tubular portions or passages 182 and 184 on end wall 140 on the opposite side thereof from impeller 44. Housing 132 has an intake elbow portion 186 having one end 188 radially aligned with openings 150 and 152, and another end 190 axially aligned with a section of intake tubular portion 182 to define branch 148. Opening 156 is axially aligned with another section of intake tubular portion 182 to define branch 154. Housing 132 has a discharge elbow portion 192 having one end 194 radially aligned with openings 162 and 164, and another end 196 axially aligned with a section of discharge tubular portion 184 to define branch 160. Opening 168 is axially aligned with another section of discharge tubular portion 184 to define branch 166. Branches 148 and 154 merge in intake tubular portion 182 adjacent endwall 140. Branches 160 and 166 merge in discharge tubular portion 184 adjacent endwall 140.

Opening 156, FIG. 7, includes a tapered intake guide surface 198 having one end 200 merging with intake tubular portion 182, and another end 202 merging with end wall 140. Tapered intake guide surface 198 extends from intake tubular portion 182 axially toward impeller 44 and radially inwardly toward the rotational axis 38 thereof to meet end wall 140 at a point 202 spaced radially inwardly of sidewall 136. Opening 168 includes a tapered discharge guide surface 204 having one end 206 merging with end wall 140 at a point spaced radially inwardly of sidewall 136, and another end 208 merging with discharge tubular portion 184. Tapered discharge guide surface 204 extends from end wall 140 axially away from impeller 44 and radially outwardly away from the rotational axis 38 thereof to meet discharge tubular portion 184.

The construction of FIGS. 3–7 eliminates wear plate 42 and gaskets 64 and 66 of FIG. 2 by providing an integrally molded one-piece cup-shaped housing assembly 132 including cylindrical sidewall 136 integral with end cap 144, and providing the end cap with a flat inner wall wear surface 140 engaging axial end 50 of impeller 44 in sealing sliding relation. The housing unit has an annular groove 210 at its open end circumscribing cylindrical sidewall 136 and facing axially away from impeller 44 and retaining a sealing gasket 212 therein engaging wear plate 40. The groove is slightly elliptical, FIG. 5, and gasket 212 is a quad ring of rectangular cross section, FIG. 6. Housing 132 is a phenolic resin thermoset material and has been found to provide adequate wear properties, enabling elimination of stainless steel wear plate 42, which in turn provides superior sealing properties by eliminating potential leakage otherwise possible at gaskets 64 and 66. It was previously felt that the abrasive particles typically found in sea water caused the greatest wear at axial ends 48 and 50, and hence stainless steel wear plates 40 and 42 were employed. Instead, it has been found that the inner diameter of the housing along wall 36 is the limiting factor and that pump life is not adversely affected by providing a phenolic resin wear surface at 140 instead of a stainless steel wear plate 42. Another advantage of housing 132 is the improved sealing provided at quad ring 212 which is self retained by the elliptical geometry of groove 210.

Figure 8:
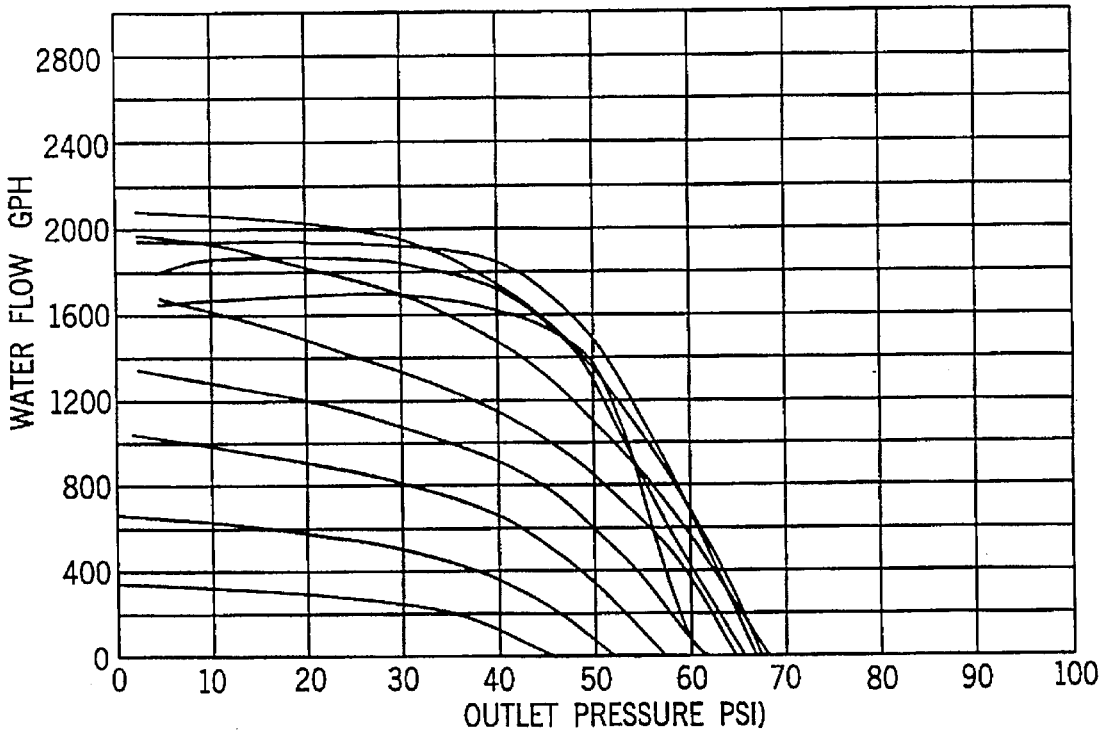
FIG. 8 PRIOR ART
FIG. 8 is a graph illustrating performance of the pump of FIG. 1.
Figure 9:
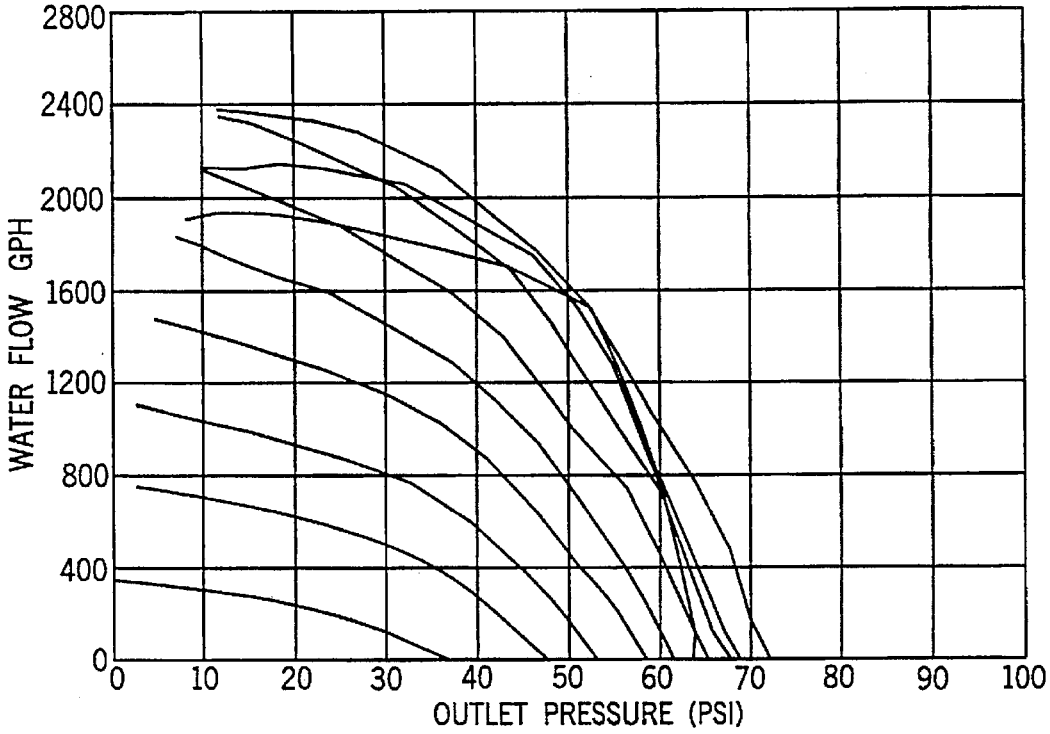
FIG. 9 is a graph illustrating performance of the pump of FIG. 3.

Improved pumping capacity is provided by the axial flow paths 178 and 180, in addition to the radial flow paths 170, 172, 174, 176. In the design of FIG. 2, maximum pumped water flow occurred at about 3,500 RPM, FIG. 8. In the design of FIGS. 3–7, maximum pumped water flow occurs at about 4,000 RPM. This is desirable because increased water flow is needed at higher RPMs to satisfy increased cooling demand. Furthermore, the maximum pumped water flow increased from about 2,100 gallons per hour, FIG. 8, to about 2,400 gallons per hour, FIG. 9. Thus, not only is the greatest flow rate provided in the speed ranges where needed, but also the amount thereof is increased.

In an alternate optional embodiment, an internally threaded drain plug hole 217, FIG. 7, may be provided in the outer lower wall of one of the ports such as 158, to which a T-headed drain plug may be matingly threaded, to allow the boat operator to drain the water without removing hoses from ports 146 or 158.

It is recognized that various equivalents, alternatives and modifications are possible within the scope of the appended claims.

We claim:

1. A sea water pump for a marine propulsion system comprising a housing having a generally cylindrical pumping chamber defined by a generally cylindrical sidewall extending axially between opposite first and second endwalls, a multi-vaned rotary impeller in said chamber, an impeller shaft extending axially into said chamber through said first endwall and drivingly rotating said impeller, an intake port having a first branch communicating with said chamber through a first opening, said first opening being through said sidewall, said intake port having a second branch communicating with said chamber through a second opening, said second opening being through said second endwall, a discharge port having a third branch communicating with said chamber through a third opening, said third opening being through said sidewall, said discharge port having a fourth branch communicating with said chamber through a fourth opening, said fourth opening being through said second endwall, wherein water flow through said first and third openings is radial, and water flow through said second and fourth openings is axial.

2. The invention according to claim 1 wherein said intake port comprises an axially extending intake passage having said first and second branches, and said discharge port comprises an axially extending discharge passage having said third and fourth branches.

3. The invention according to claim 2 wherein said intake and discharge ports each extend axially from said second endwall.

4. The invention according to claim 1 wherein:

said intake and discharge ports comprise axially extending respective intake and discharge tubular portions on said second endwall on the opposite side thereof from said impeller;

said housing has an integral intake elbow portion having one end radially aligned with said first opening, and another end axially aligned with a section of said intake tubular portion to define said first branch;

said second opening is axially aligned with another section of said intake tubular portion to define said second branch;

said housing has an integral discharge elbow portion having one end radially aligned with said third opening, and another end axially aligned with a section of said discharge tubular portion to define said third branch;

said fourth opening is axially aligned with another section of said discharge tubular portion to define said fourth branch.

5. The invention according to claim 4 wherein:

said first and second branches merge in said intake tubular portion adjacent said second endwall;

said third and fourth branches merge in said discharge tubular portion adjacent said second endwall.

6. The invention according to claim 4 comprising:

a fifth opening into said chamber adjacent said first opening and communicating with said one end of said intake elbow portion;

a sixth opening into said chamber adjacent said third opening and communicating with said one end of said discharge elbow portion;

wherein water flow through said fifth and sixth openings is radial.

7. A sea water pump for a marine propulsion system comprising a housing having a generally cylindrical pumping chamber defined by a generally cylindrical sidewall extending axially between opposite first and second endwalls, a multi-vaned rotary impeller in said chamber, an impeller shaft extending axially into said chamber through said first endwall and drivingly rotating said impeller, an intake port having a first branch communicating with said chamber through a first opening, said first opening being through said sidewall, said intake port having a second branch communicating with said chamber through a second opening, said second opening being through said second endwall, a discharge port having a third branch communicating with said chamber through a third opening, said third opening being through said sidewall, said discharge port having a fourth branch communicating with said chamber through a fourth opening, said fourth opening being through said second endwall, wherein water flow through said first and third openings is radial, and water flow through said second and fourth openings is axial; wherein said intake and discharge ports comprise axially extending respective intake and discharge tubular portions on said second endwall on the opposite side thereof from said impeller;

said housing has an intake elbow portion having one end radially aligned with said first opening, and another end axially aligned with a section of said intake tubular portion to define said first branch;

said second opening is axially aligned with another section of said intake tubular portion to define said second branch;

said housing has a discharge elbow portion having one end radially aligned with said third opening, and another end axially aligned with a section of said discharge tubular portion to define said third branch;

said fourth opening is axially aligned with another section of said discharge tubular portion to define said fourth branch; wherein:

said second opening includes a tapered intake guide surface having one end merging with said intake tubular portion and another end merging with said second endwall, said tapered intake guide surface extending from said intake tubular portion axially toward said impeller and radially inwardly toward the rotational axis thereof to meet said second endwall at a point spaced radially inwardly of said sidewall;

said fourth opening includes a tapered discharge guide surface having one end merging with said second endwall at a point spaced radially inwardly of said sidewall and another end merging with said discharge tubular portion, said tapered discharge guide surface extending from said second endwall axially away from said impeller and radially outwardly away from the rotational axis thereof to meet said discharge tubular portion.

8. A simplified integrally molded one-piece housing assembly for a sea water pump for a marine propulsion system comprising a cup-shaped housing unit having a generally straight-sided cylindrical sidewall integral with an endwall to define a generally cylindrical chamber which is open at one end, and which is closed at the other end by said integral endwall, said chamber receiving a multi-vaned rotary impeller driven by an impeller shaft extending through a wear plate into said chamber, said wear plate closing said chamber at said one end, said cup-shaped housing unit having water intake and discharge ports including respective openings into said chamber; comprising:

a first opening into said chamber through said sidewall;

a second opening into said chamber through said endwall;

a third opening into said chamber through said sidewall;

a fourth opening into said chamber through said endwall;

wherein:

said first and second openings communicate with said intake port;

said third and fourth openings communicate with said discharge port;

water flow through said first and third openings is radial;

water flow through said second and fourth openings is axial.

9. The invention according to claim 8 wherein said housing unit has a generally annular groove at said one end circumscribing said cylindrical sidewall and facing axially away from said impeller and retaining a sealing gasket therein engaging said wear plate.

10. A simplified integrally molded one-piece housing assembly for a sea water pump for a marine propulsion system comprising a cup-shaped housing unit having a generally straight-sided cylindrical sidewall integral with an endwall to define a generally cylindrical chamber which is open at one end, and which is closed at the other end by said integral endwall, said chamber receiving a multi-vaned rotary impeller driven by an impeller shaft extending through a wear plate into said chamber, said wear plate closing said chamber at said one end, said cup-shaped housing unit having water intake and discharge ports including respective openings into said chamber;

wherein said housing unit has a generally annular groove at said one end circumscribing said cylindrical sidewall and facing axially away from said impeller and retaining a sealing gasket therein engaging said wear plate;

wherein said groove is slightly elliptical, and said gasket is a quad ring of rectangular cross-section.

* * * * *